United States Patent [19]

Saviez

[11] Patent Number: 4,809,374

[45] Date of Patent: Mar. 7, 1989

[54] PADDING BODY CONSTITUTED OF INDIVIDUAL MODULAR ELEMENTS, AND ITS APPLICATION TO THE PRODUCTION OF SEATS AND OF REMOVABLE CUSHIONS OR BACK-RESTS

[76] Inventor: Joseph Saviez, 10 Square Saint Philbert, 49300 Cholet, France

[21] Appl. No.: 1,323

[22] Filed: Jan. 7, 1987

[30] Foreign Application Priority Data

Jan. 15, 1986 [FR] France ..... 86 00514

[51] Int. Cl.[4] ..... A47C 27/00

[52] U.S. Cl. ..... 5/420; 5/446; 5/465; 5/468

[58] Field of Search ..... 5/417, 420, 437, 440, 5/446, 461, 464, 465, 468, 481; 297/453

[56] References Cited

U.S. PATENT DOCUMENTS

| | | | |
|---|---|---|---|
| 3,885,259 | 5/1975 | Cheong | 297/453 X |
| 4,383,342 | 5/1983 | Forster | 5/432 |
| 4,535,495 | 8/1965 | Oldfield | 5/432 |

FOREIGN PATENT DOCUMENTS

| | | | |
|---|---|---|---|
| 1310373 | 3/1973 | United Kingdom | 5/481 |
| 2025234 | 1/1980 | United Kingdom | 5/465 |

OTHER PUBLICATIONS

Comfortable Decubitus Without Risks with Preventix (Article ) 4 pages, Translation Included.

*Primary Examiner*—Gary L. Smith
*Assistant Examiner*—Michael F. Trettel
*Attorney, Agent, or Firm*—Ladas & Parry

[57] ABSTRACT

The invention relates to a padding body constituted of a flat support on one face of which are provided spaced apart protuberances. Said padding body is formed of modular elements held in position by a support means constituted by a grid or a plate.

According to the invention, said padding body has the advantage of being able to take on various shapes, depending on the required application.

The present invention finds an application in the production of seats and of removable cushions and backrests.

14 Claims, 2 Drawing Sheets

PADDING BODY CONSTITUTED OF INDIVIDUAL MODULAR ELEMENTS, AND ITS APPLICATION TO THE PRODUCTION OF SEATS AND OF REMOVABLE CUSHIONS OR BACK-RESTS

The present invention relates to an improved padding body constituted of a flat support of which one face is provided with spaced apart protuberances.

The principle of this type of padding body is already known from French patent application No. 2 428 999, which describes a monobloc padding body provided on one face with regularly spaced out cylindrical protuberances. Due to its monobloc structure, this padding body is of limited use because it cannot adapt to the different applications which require equally different configurations.

Another type of cushion or padding body is known from document DE-3 303 615, which is formed by the combination of about two hundred inflatable individual elastic hollow elements 2, arranged on a support plate 1 in plastic material, subdivided into as many compartments as necessary by intermediate partitions which prevent a lateral displacement.

The support plate 1 comprises orifices 4 which make it possible to reduce the cost and weight of the plate, but which are clearly smaller than said individual elements 2.

It is now the object of the present invention to propose a padding body which, as opposed to those described in the prior art, permits an extremely simple alteration of the configuration as a function of the required application, and facilitates the manufacture and mounting of the assembly, while preserving a rigidity thereof, hence ensuring a perfect functioning.

The invention proposes to this effect an improved padding body, which is constituted of a flat support on one face of which are provided spaced apart protuberances, wherein said padding body is formed of individual modular elements inserted in openings provided in a support means thus connecting the modular elements one to the other in spaced apart manner.

Although a number of different means can be used without departing from the scope of the invention, it has been found that it is very advantageous to use a plate or even a grid, in the meshes of which are inserted the modular elements.

Moreover, said modular elements are preferably formed of a base topped by one or more protuberances.

In the case of one or more protuberances, these, which are regularly spaced out on the base, are inserted in the openings of the support means (plate or grid), the base being brought to rest against the support means due to its size (cross-section) which is greater than that of said opening. The bases are advantageously of such a shape that the assembly thereof forms a continuous support. In order to further maintain the cohesion of the assembly, it is possible for the bases to have a structure which enables them to fit one inside the other.

The protuberances may be of different shapes, such as cylindrical, truncated cone-shaped or truncated pyramid-shaped, depending on the required application.

They may also be constituted of small pads filled with air or have a central cavity at the level of the base.

According to a particular embodiment of the invention, the cross-section of the openings is substantially circular or even polygonal, its size being either slightly less than, or equal to or slightly more than the cross-section of the protuberances.

According to another embodiment of the invention, the modular elements are covered with at least one layer of wet-proofing or coloring product.

According to yet another embodiment of the invention, the modular elements are produced in two or more parts, joined together by any appropriate means, such as adhesive means for example.

The height of these protuberances can vary and this is precisely one of the essential advantages of the present invention. For example, depending on the modular elements selected, it will be possible to place those protuberances which are higher than the others, at the level of the longitudinal central zone (to support the spine), at the level of the longitudinal edges (to immobilize) and at the level of the lower transversal zone (for the lumbar vertebrae).

Moreover, the resistance to pressure of said protuberances is variable, either because of the use of materials of different densities, or because of the use of modules of different height, or because of both or of any other means permitting a variation of the resistance to the pressure exerted on each module.

The padding body according to the invention finds an advantageous application in the production of back-rests and seats for armchairs, and in particular for vehicle seats.

The invention will be more readily understood on reading the following description with reference to the accompanying drawings, in which.

Figure 1:
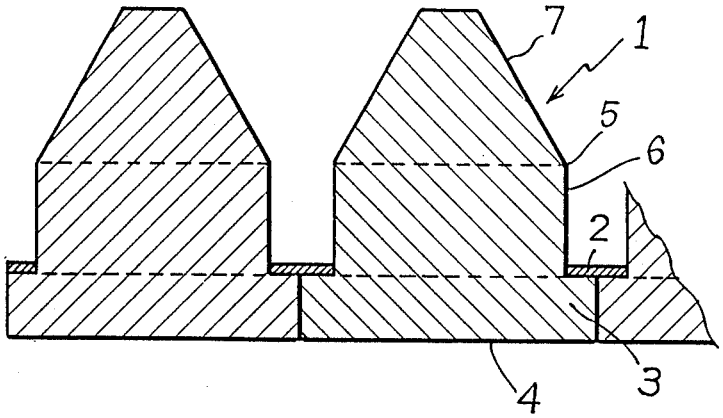
FIG. 1 is a cross-sectional view of a portion of the padding body according to the invention.
Figure 2:
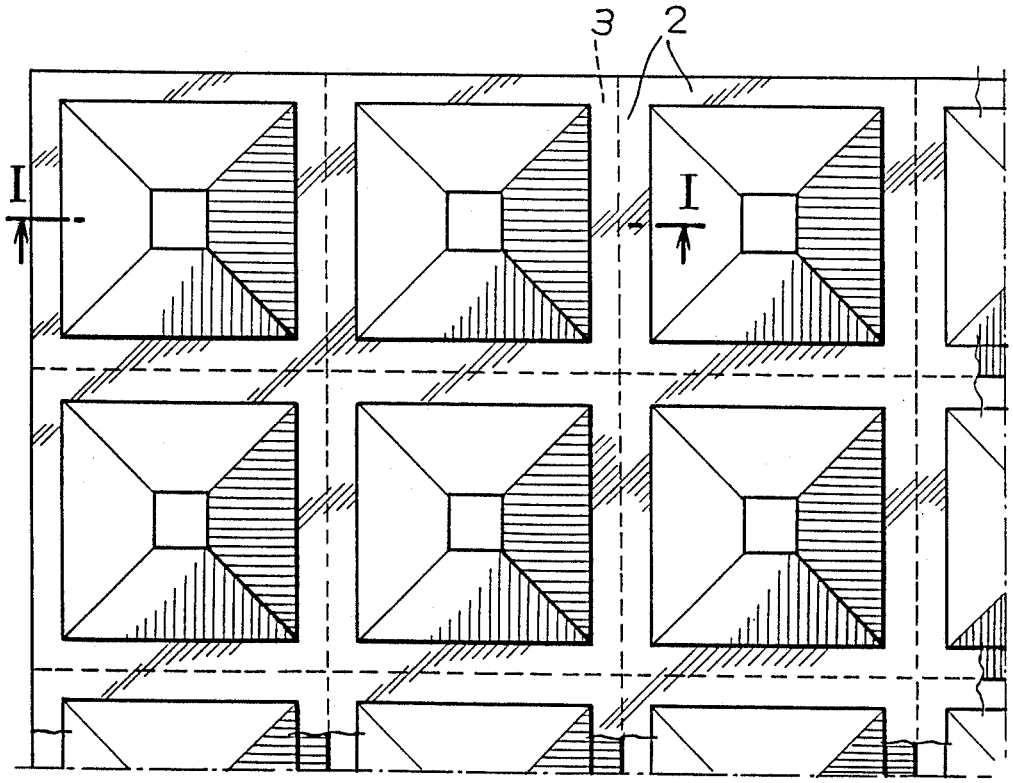
FIG. 2 is a plan view of the same portion.

Referring first to FIGS. 1 and 2, these show that the padding body 1 is constituted of a support means 2 which, in the illustrated case, is a plate or grid 2, with square meshes defining openings in which are engaged individual modules 3. Said modules are formed of a base 4 the surface or cross-section of which is slightly greater than the surface or cross-section of the mesh, said base being topped over by a protuberance 5 which comprises a part 6 with vertical walls close to the base with square cross-section, and a part 7 of truncated pyramid shape. Part 6 has a square cross-section identical to that of the opening or mesh or slightly greater, so that said opening or mesh can exert a certain grasp on said part 6 thus holding the module 3 in position.

Figure 3A:
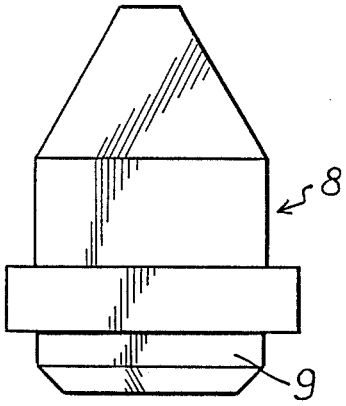
FIG. 3 is a front view of two different modules (3*a*) and (3*b*) which can also be used in the present invention.
Figure 3B:
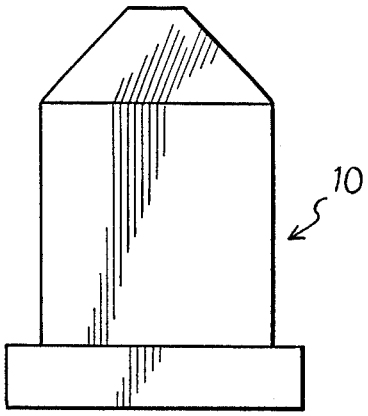

According to FIG. 3, the modules 8 can also comprise another protuberance 9 opposite to the first (FIG. 3*a*) which comprises a part close to the base, of which the cross-section is square. Said modules can be used to compensate any hollows forming in the support on which rests the padding body. Thus, understandably, depending on the shape of the support, said modules 8 will be placed in the wanted spots, in order to preserve the flat nature of the padding body. According to another variant, the modules 10 may be higher than the modules 3. This enables the shape of the padding body to adapt to the shape of the human body as explained hereinabove.

Moreover, the modules 8 which have protuberances on both their faces can be used in the production of padding bodies usable without a mattress, due to the addition of a second plate or grid on the lower face side, at a certain distance from the first plate or grid, namely in intermediate position so as to rigidify the protuberances resting on the ground. Accordingly, said second plate or grid will have openings of cross-section slightly greater than the protuberances, so as to be held in the intermediate position given thereto, and to be unable to move even when someone is lying down on the mattress.

Figure 4A:
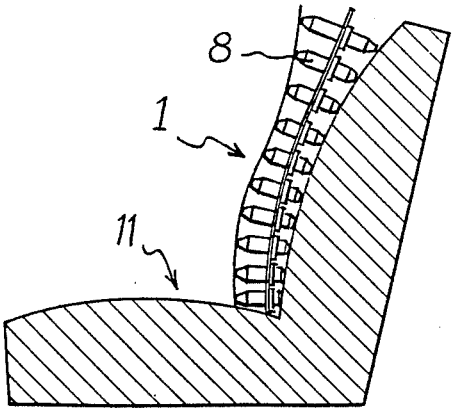
FIG. 4 is a cross-sectional view of two seats of which the back-rest is equipped with a padding body according to the invention (4*a*) and (4*b*).

FIG. 4 shows one possible use of the padding body in the manufacture of a seat 11. The modules may be, for example, in polyurethane foam, or polyethylene foam, or supple elastomer or any other suitable material of variable density. According to said FIG. 4, and more particularly FIG. 4*a*, the padding body 1 can form a back rest by being positioned on the back of seat 11 and being held there by any appropriate means. Said padding body is formed of modules of different height depending on the position relatively to the back of the seat (FIG. 4*a*).

The padding body is provided with modules with lower protuberance at the level of the lumbar vertebrae and at the level of the cervical vertebrae.

Figure 4B:
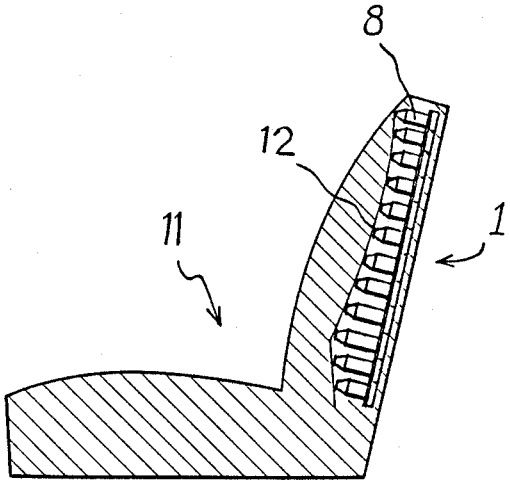

FIG. 4*b* shows another possible use of the padding body inside the back rest proper, without any lower protuberance, and with a material covering 12.

Generally, the padding body can adapt to the human morphology, and medically, it can serve as a support for any part of the body in contact therewith, depending on the pressure exerted by every modular element.

Obviously, the invention is not limited to the embodiments described hereinabove and modifications can be brought thereto without departing from its scope.

The plate or grid 2 constitutes a support means for the individual modular elements 3 and can be produced in any material presenting a suppleness under a bending stress, hence an adaptability to any shape, such as, for example, to the curved shape of a back rest. In general, said plate or support is produced in a plastic material such as polyethylene or polypropylene.

What is claimed is:

1. A padding body having a front face and a rear face essentially comprising individual modular elements extending from said front face to said rear face introduced in openings made in a support means connecting the individual modular elements one to the other in a spaced manner, said individual modular elements comprising protuberances on said front and rear faces, said modules being sandwiched between two support means, and wherein said padding body is used without a mattress.

2. A padding body having a front face and a rear face essentially comprising individual modular elements extending from said front face to said rear face introduced in openings made in a support means connecting the individual modular elements one to the other in a spaced apart manner, said individual modular elements having a padding part ending at said front face and a base part ending at said rear face and integral with said padding part, said base part being aimed to lie on a rest surface, such as the ground, for improved padding by individual padding caused by said individual modular elements, and improved adaptability to any shape, such as the human morphology or the curved shape of a back-rest.

3. A padding part as claimed in claim 2, wherein the individual modular elements are formed of a base part topped over with one or more protuberances constituting said padding part.

4. A padding body as claimed in claim 3, wherein the protuberances are of cylindrical shape.

5. A padding body as claimed in claim 3, wherein the protuberances are truncated cone-shaped or truncated pyramid-shaped.

6. A padding body as claimed in claim 2, wherein each individual modular element is constituted of the base part topped over with one protuberance as the padding part.

7. A padding body as claimed in claim 2, wherein the base part of said individual modular elements is so shaped that all the base parts form a continuing support aimed to lie on a rest surface.

8. A padding body as claimed in claim 2, wherein the individual modular elements are of different height, said padding body having a longitudinal central zone, longitudinal edges and a lower transversal zone, said padding part comprising at least one protuberance higher at the level of the longitudinal central zone, at the level of the longitudinal edges and at the level of the lower transversal zone.

9. A padding body as claimed in claim 2, wherein said support means comprises a plate in which are provided said openings, or a grid of which the meshes define said openings.

10. A padding body as claimed in claim 2, wherein the modular elements are covered with at least one layer of a wet-proofing or coloring product.

11. A padding body as claimed in claim 2, wherein the cross-section of said openings is substantially circular and is either slightly smaller than the cross-section of said protuberances, or equal thereto, or slightly greater.

12. A padding body as claimed in claim 2, wherein the cross-section of said openings is substantially polygonal, and is slightly smaller than the cross-section of said protuberances, or equal thereto or slightly greater.

13. A padding body as claimed in claim 2, wherein said modular elements are made up in two parts joined together by any appropriate means, such as for example by adhesive means.

14. Back-rest for a seat, comprising a padding body as claimed in claim 2, used as it is, or covered over with a cover material.

* * * * *